United States Patent [19]

Parry

[11] 4,301,341

[45] Nov. 17, 1981

[54] ELECTRICAL SWITCHGEAR

[75] Inventor: John Parry, Blackwood, England

[73] Assignee: South Wales Switchgear Limited, Gwent, England

[21] Appl. No.: 96,417

[22] Filed: Nov. 21, 1979

[51] Int. Cl.[3] ..... H01H 33/18

[52] U.S. Cl. ..... 200/147 R; 200/146 R; 200/148 R

[58] Field of Search ..... 200/147 R, 146 R, 148 R

[56] References Cited

U.S. PATENT DOCUMENTS

| | | | |
|---|---|---|---|
| 1,827,516 | 10/1931 | Greenwood | 200/147 R |
| 2,027,219 | 1/1936 | Austin | 200/147 R |
| 3,274,365 | 9/1966 | Beatty | 200/147 R |
| 3,471,666 | 10/1969 | Barkan | 200/147 R |

*Primary Examiner*—Robert S. Macon
*Attorney, Agent, or Firm*—Charles E. Brown

[57] ABSTRACT

On opening of a circuit breaker, an end portion of a pivotable contact arm disengages from fixed contacts such that an arc is drawn therebetween radially across the pole face of a field coil, the end portion of the contact arm moving transversely to the field coil axis. The arc then transfers from the fixed contacts to a tubular electrode thereby bringing the field coil into circuit so that a magnetic field is generated which causes the arc to rotate and become extinguished. In the fully-open position of the circuit breaker, the end portion of the contact arm lies along the field coil axis. The whole assembly is disposed in a housing which contains the highly insulating gas sulphur hexafluoride. A single field coil and electrode can be shared between two such constructions. In addition, the initial arc can be drawn directly between the contact arm and the tubular electrode, rather than being transferred to the electrode from the fixed contacts.

24 Claims, 14 Drawing Figures

ELECTRICAL SWITCHGEAR

This invention relates to electrical switchgear, the term "switchgear" being used to embrace circuit breakers and other electrical switches.

In recent years, circuit breakers have been developed which make use of the highly insulating gas sulphur hexafluoride to extinguish an arc drawn between contacts.

It is not generally sufficient to rely on the properties of the gas alone, and a known technique of arc extinction when using this gas is to transfer the arc drawn between a moving and a fixed contact from the fixed contact to an arcing electrode which is connected to the fixed contact through a field coil, so that the arc current passing through the field coil causes a magnetic field to be generated which makes the arc rotate and become extinguished. The success of this technique naturally requires that the magnetic field generated shall have sufficient intensity to make the arc rotate. The intensity of the magnetic field does, however, depend upon the strength of the current passing through the field coil. In practice, one can usually rely on the arc current in a circuit breaker operating under short circuit conditions to be sufficient to create arc rotation.

Circuit breakers and other switches have also to interrupt currents of lower magnitude, for example, load currents, capacitive currents in unloaded cables and the small inductive currents associated with unloaded transformers and rotating machines. When breaking low currents, a rotary arc device may fail to transfer the arc to the arcing electrode and to create subsequent rotation.

A common form of distribution switchgear for voltages up to 36 kilovolts incorporates circuit breakers of the oil-filled type isolated from fixed units by vertical withdrawal. This range of switchgear also incorporates non-automatic load break switches and, especially for voltages of 12 kilovolts and lower, ring main equipment incorporating at least three switch functions to control, for example, a transformer and two ring main cables.

Although this type of equipment has been used satisfactorily for many years, it would be desirable to apply to it the use of sulphur hexafluoride to gain the advantages of higher interrupting performance with a corresponding reduction in the frequency of contact maintenance and freedom from fire hazard.

The application of a rotating-arc sulphur hexafluoride system is particularly desirable for this class of equipment because of the small mechanical energy requirements resulting from the relatively short contact stroke and the fact that a mechanical compression device or puffer is not required.

Difficulties in applying rotating arc sulphur hexafluoride techniques to circuit breakers and switches of the size associated with distribution switchgear up to 36 kilovolts include the need to ensure that the arc can be made to rotate reliably at all values of breaking current and the need to provide a compact and economical arrangement which is not at a disadvantage in size or requirements of mechanical operating energy with respect to oil-filled equipment.

It is an object of the present invention to obviate or mitigate these difficulties.

According to the present invention, there is provided electrical switchgear employing an electrically insulating fluid for arc extinction and comprising a switch having first and second contact means relatively movable between a closed position in which they are mutually engaged and an open position in which they are mutually separated, a field coil electrically connected in series with an arcing electrode such that during movement of the first and second contact means towards their open position an arc is formed between the first contact means and the arcing electrode, the arcing current passing through the field coil to create an arc-rotating magnetic field to extinguish the arc, the first contact means including a contact member pivotable about an axis transverse to the axis of the field coil and having an end portion which engages the second contact means when the contact means are in their closed position and which moves transversely to and inward of the field coil axis on movement of the contact means towards their open position.

The use of a pivotable contact member has the advantage that the pivot point controls the geometry of movement of the contact member, no additional guides being required for this purpose. In addition, movement of the contact member between its open and closed positions can be performed by means of a lay shaft through the intermediary of a simple crank arm. These factors enable a compact construction to be obtained, and in particular the switchgear can be made small enough to replace existing oil-filled circuit breakers of similar ratings.

In certain applications, it is necessary to bypass the mounting of the contact member with a flexible connector, such that the bulk of the current flowing through the switchgear passes through the connector rather than through the mounting. The use of a pivotal mounting for the contact member enables such a flexible connector to be positioned close to the pivot point where it is subject to minimal deflection: because of this, flexure of the connector presents only a small load to the mechanism by means of which the contact member is operated. Moreover, any frictional effects caused by pivotal movement of the contact member occur at the pivotal mounting which again presents only a small load to the operating mechanism for the contact member. This is to be contrasted with the type of circuit breaker in which the contact member is slidable rectilinearly, since a sliding contact must be applied to the contact member which adds a constant load to the operating mechanism.

Preferably, the switchgear is of the so-called single break type, in which the first and second contact means are electrically connected to respective external terminals. The use of a contact member which moves transversely of the field coil axis in such a single break type of construction enables the field coil to be shared between two adjacent circuits, resulting in a compact construction. Moreover, where the switchgear includes three separate switches in a common housing for respectively controlling the phases of a three-phase electrical supply, this enables the field coils to be disposed in a triangular array to obtain maximum separation therebetween.

Preferably, said end portion of the contact member is elongate and lies along the axis of the field coil when the contact means are in their open position.

Embodiments of the present invention will now be described, by way of example, with reference to the accompanying drawings, in which.

Figure 1:
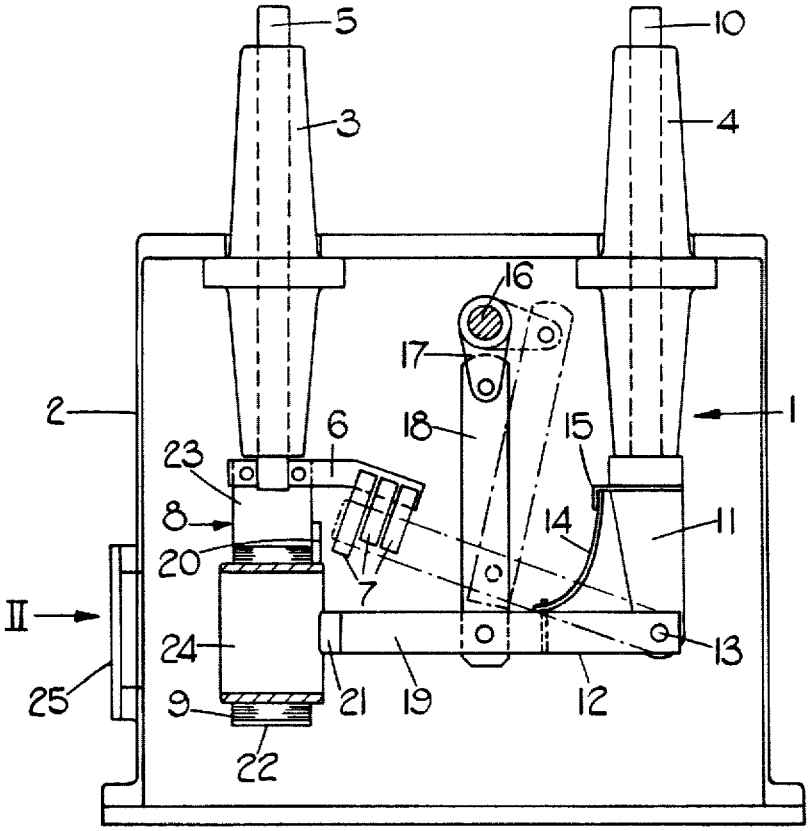
FIG. 1 is a schematic diagram of a first embodiment of electrical switchgear according to the present invention, in the form of a circuit breaker for a single-phase electrical supply or one phase of a circuit breaker for a three-phase supply.

Referring to FIG. 1, a circuit breaker is shown suitable for replacing an existing 12 or 36 kilovolt oil-filled circuit breaker in an electrical distribution system. The circuit breaker comprises a switch 1 contained in a gas-tight metal housing 2 on which terminal bushings 3 and 4 are mounted. The housing 2 and terminal bushings 3 and 4 corresponds respectively to the tank and bushings of a conventional oil-filled circuit breaker. The interior of the housing 2 does not, however, contain oil but the well-known, highly insulating gas sulphur hexafluoride for the purpose of arc quenchings. The gas is present preferably at a pressure of 45 psi, and is supplied through a valve (not shown) in a wall of the housing 2. The mechanism of the circuit breaker is so constructed and arranged as to enable sulphur hexafluoride arc quenching to be applied to the breaking of currents occurring in an electrical distribution system within the space limitation imposed by making the circuit breaker a replacement for an existing oil-filled circuit breaker.

A conductor 5 passes through the bushing 3 and carries on its end within the housing 2 a transverse contact support arm 6 which carries resilient contact fingers 7, and a support member 8 which carries a field coil 9. A conductor 10 passes through the bushing 4 and carries on its end within the housing 2 a mounting 11 on which a movable contact arm 12 of circular cross-section is mounted for angular movement about a pivot 13. A flexible, electrically conductive strap 14 connects the contact arm 12 to the conductor 10 for the passage of most of the load current therethrough, the strap 14 being connected to the conductor 10 by way of an L-shaped copper bracket 15 and being bolted to the contact arm 12. As an alternative to the provision of the strap 14, the contact arm 12 can be mounted on the end of the conductor 10 by means of a spring loaded pivot through which the load current passes in use.

An operating shaft 16 is rotatable by means of an operating mechanism (not shown) disposed externally of the housing 2 and carries an arm 17 which is pivotally connected to one end of a linkage comprising a pair of parallel, spaced links 18 (only one shown) made of insulating material, such as PERMALI (Registered Trade Mark) which is a densified resin beech. The other end of the linkage is pivotally connected to the contact arm 12 at or near the centre of the latter, such that rotation of the shaft 16 causes the contact arm 12 to move angularly about the pivot 13 between a position in which an end portion 19 thereof is engaged with the contact fingers 7 (as shown in chain-dotted lines) and a position in which the end portion 19 is disengaged from the fingers 7 and is disposed on the axis of the field coil 9 (as shown in full lines). In the latter position of the contact arm 12 the axis of the operating shaft 16, the pivotal connection between the arm 17 and the linkage 18 and the pivotal connection between the linkage 18 and the contact arm 12 are substantially in a common plane. Therefore, any slight movement of the arm 17 due, for example, to play between the various parts or oscillation of the parts due to the absorbing of shocks upon opening of the switch will result in only a very small movement of the contact arm 12, and thus the end portion 19 thereof will remain substantially on the axis of the field coil 9.

A plate 20 of arc-resistant material is provided adjacent the contact fingers 7 to protect the support member 8 and the field coil 9 from the effects of arcing. The arc-resistant material of which the plate 20 is made can be either conducting or insulating. If it is conducting, it must be ensured that the plate cannot short out the field coil 9. This can be arranged by fixing the plate 20 at an angle to the support member 8 so that it is normal to the end portion 19 of the contact arm 12 when the latter engages the contact fingers 7 and is directed away from the outer windings of the field coil and the support member 8. If necessary, for certain applications of the switchgear, the end portion 19 of the contact arm 12 can have a region 21 which is also protected by conducting arc-resistant material.

Figure 2:
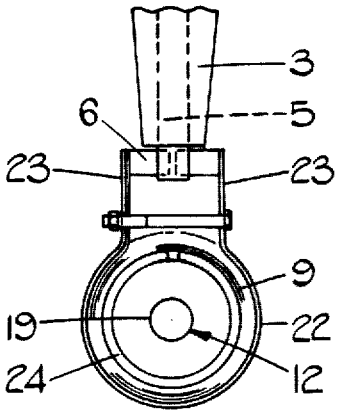
FIG. 2 is a view in the direction of arrow II in FIG. 1 of part of the electrical switchgear shown therein.

The support member 8 is made of mild steel such that it serves to concentrate the magnetic field produced by the field coil 9 and screens the coil from the effects of adjacent metalwork or current-carrying conductors. The support member comprises a portion 22 defining part of a cylinder (as shown to advantage in FIG. 2) carried on integral mounting lugs 23. The field coil 9 comprises a spiral metal strip of the same width as the portion 22 and consists of, for example, twenty turns of sheet metal 0.5 mm thick. The turns are equally spaced from each other, insulation between the turns being provided by means of an insulating coating or an interwound insulating strip. An inner end of the field coil 9 is attached to and assists in supporting a tubular arcing electrode 24 made of non-ferrous metal which projects beyond the ends of the field coil and its support member. A suitable means of attaching the inner end of the field coil to the electrode is by rivetting and/or brazing or soldering. An outer end of the field coil is bolted between one of the lugs 23 and the support arm 6, as can be seen in FIG. 2.

The above-described circuit breaker operates as follows. In a closed position thereof, the end portion 19 of the contact arm 12 is engaged with the contact fingers 7 so that current can flow through the circuit breaker by way of the conductor 10, the strap 14, contact arm 12, contact fingers 7 and the conductor 5. Opening of the circuit breaker is performed by rotating the operating shaft 16 by way of the aforementioned operating mechanism to pivot the contact arm 12 out of engagement with the contact fingers 7. During such movement of the contact arm 12, the end portion 19 thereof moves transversely relative to the end of the field coil 9 to draw an arc from the contact fingers 7 radially across the pole face of the coil. This arc subsequently transfers itself from the contact fingers 7 to the electrode 24, so that the field coil 9 (previously out of circuit) now forms part of the current flow path through the circuit breaker. The current flowing through the coil 9 creates a magnetic field which causes the arc to rotate in a known manner and become extinguished.

A porthole 25 is provided in side wall of the housing 2 so that a visual inspection can be made of the internal mechanisms. The porthole also permits photography of the rotating arcs to be taken.

The above arrangement can, if desired, be applied to a mere switch rather than to a circuit breaker.

The circuit breaker described above is intended to control one phase of a three phase electrical supply, similar circuit breakers being provided for the other two phases. The circuit breaker is, however, also suitable for controlling a single phase electrical supply.

Figure 3:
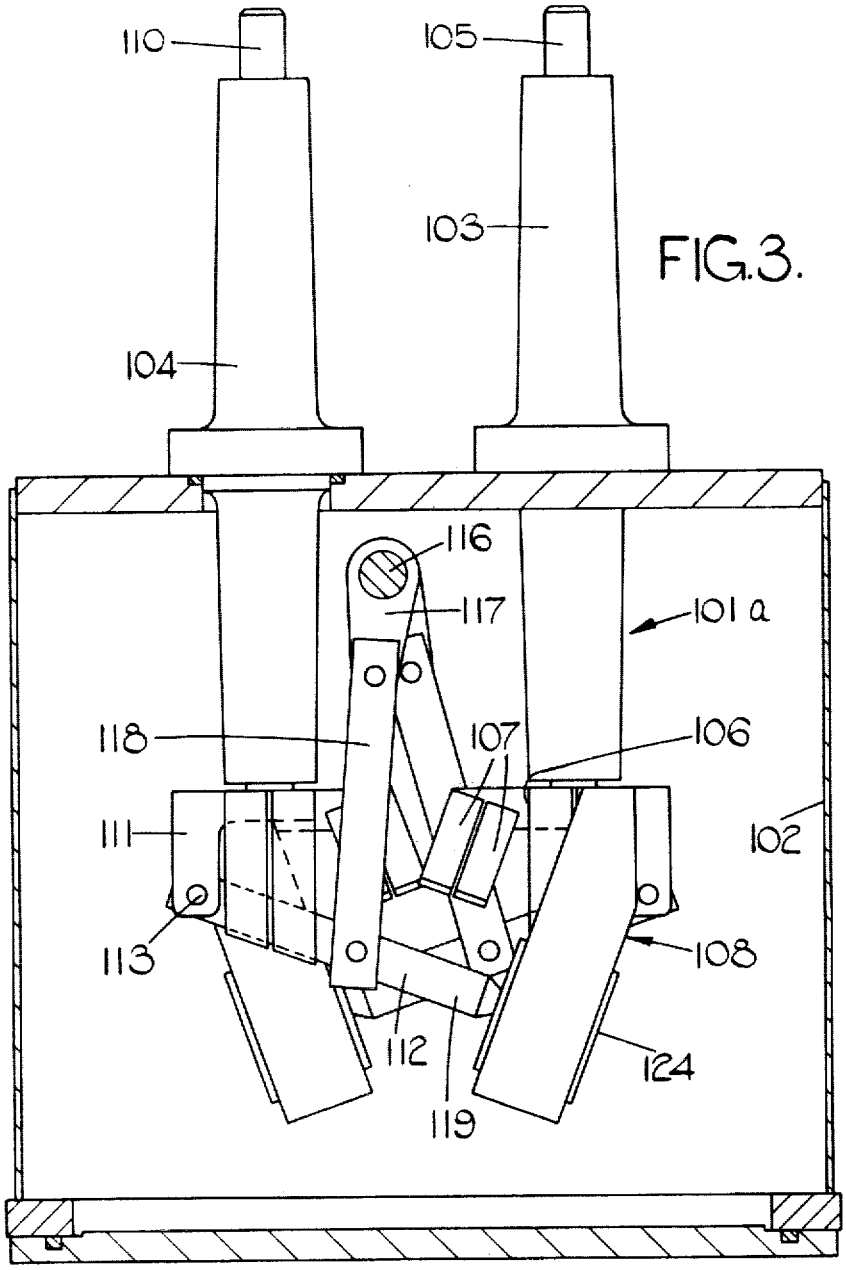
FIG. 3 is a side view, partly in section, of a second embodiment of electrical switchgear according to the present invention.
Figure 4:
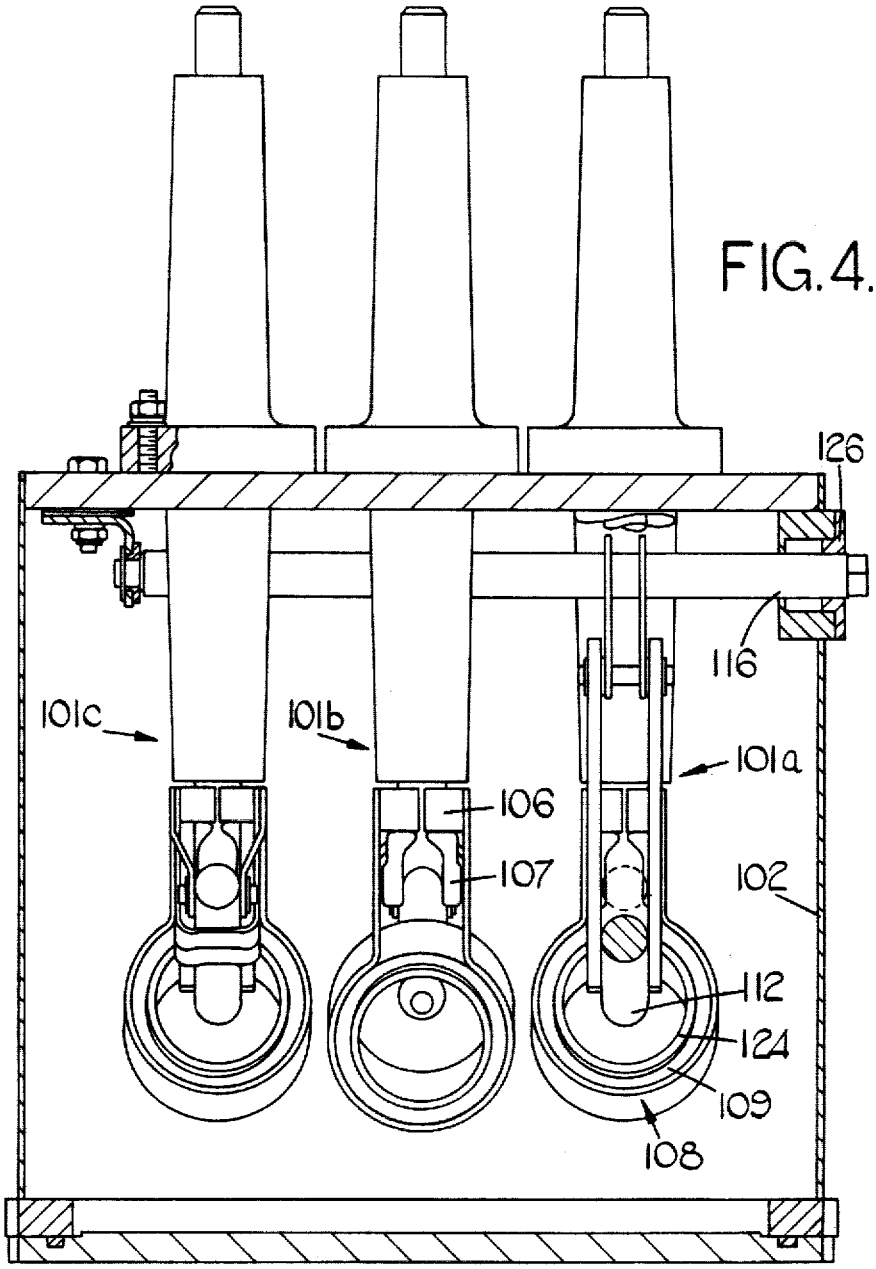
FIG. 4 is a front view, partly in section, of the electrical switchgear shown in FIG. 3.
Figure 5:
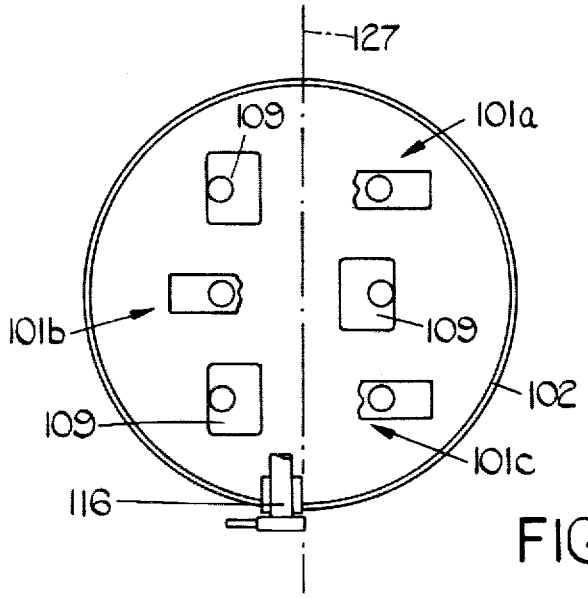
FIG. 5 is a schematic plan view of the electrical switchgear shown in FIGS. 3 and 4.

The switchgear illustrated in FIGS. 3 to 5 is in the form of a circuit breaker for use with a three phase electrical supply, and comprises three switches 101*a*, 101*b* and 101*c* (one for each phase) contained in a common housing 102 filled with sulphur hexafluoride gas. Each of the switches is similar to that described above with reference to FIGS. 1 and 2, similar parts being denoted by the same reference numerals but with 100 added. A common operating shaft 116 is used to operate all three of the switches, and passes through a gas-tight bearing 126 in a side wall of the housing 102.

The three switches are disposed generally on a common axis 127. In order to optimise the electrical clearances and magnetic separations of the switches, the field coils 109 thereof are mutually staggered transversely of the axis 127. In the particular arrangement shown, this means that the coils 109 are disposed in a triangular array, as can be seen to advantage in FIG. 5. The screening effect performed by the support members 108 is now of particular importance, since each support member shields its respective coil 109 from the effects of the other phases of the electrical supply.

Figure 6:
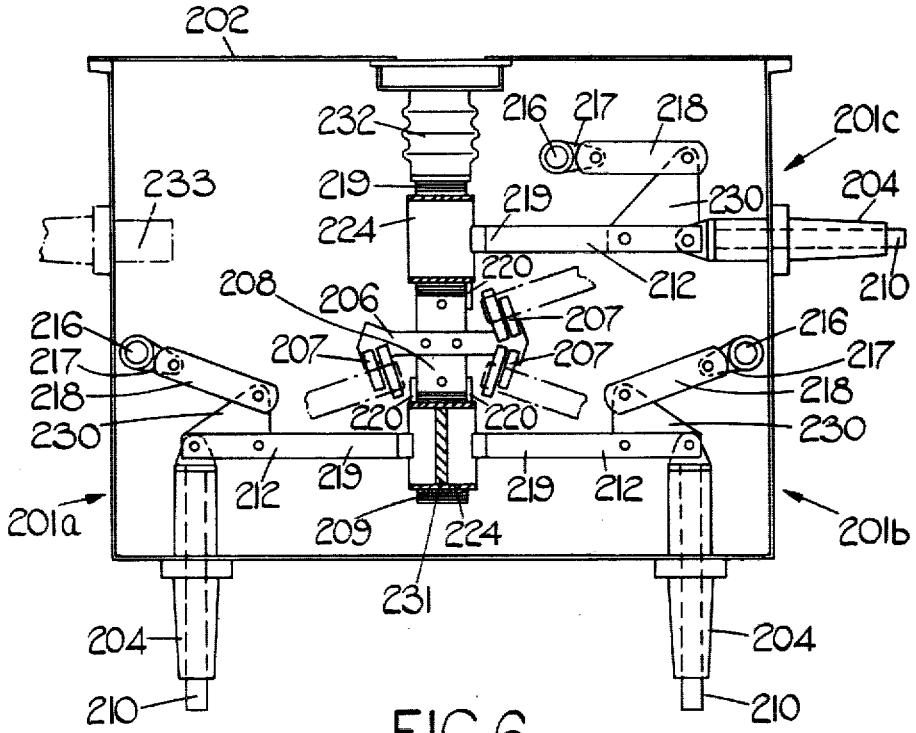
FIG. 6 is a schematic diagram of a third embodiment of electrical switchgear according to the present invention, for use with ring main equipment.

FIG. 6 illustrates switchgear for use with ring main equipment and comprises a pair of switches 201*a* and 201*b* for controlling respective ring main cables and a third switch 201*c* for a tee-off circuit. The switch 201*c* can provide automatic circuit breaking and/or can be associated with an externally-mounted high-capacity fuse: where three phases are provided, blowing of one such fuse can be arranged to cause the tee-off switches of all three phases to open.

Each of the switches 201*a*, 201*b* and 201*c* is generally similar to the switch 1 described above in relation to FIGS. 1 and 2, similar parts being accorded the same reference numerals but with 200 added. However, the link mechanism which connects the operating shaft 216 of each switch to the respective contact arm 212 differs slightly from the arrangement depicted in FIG. 1, in that triangular plates 230 are provided on the contact arm and the linkage 218 is pivotally connected to these plates, rather than being connected directly to the contact arm.

The ring main switches 201*a* and 201*b* are disposed adjacent one another and share a common field coil 209, support member 208 and arcing electrode 224. The contact arms 212 of the two switches are disposed at opposite ends of the field coil 209, and an electrically insulating member 231 extends transversely across the centre of the electrode 224 to help isolate the contact arms from each other when the switches are both in their open positions. Because the field coil 209 is spirally wound, it is symmetrical about a transverse plane through its centre: the coil 209 can, therefore, be relied upon to provide the same operating characteristics for each of the two switches 201*a* and 201*b*. A mechanical interlock (not shown) of the known type is provided to prevent simultaneous opening of the switches 201*a* and 201*b* although consecutive opening (after the arc in one circuit has been extinguished) is permitted.

The field coil 209, support member 208 and arcing electrode 224 which are common to the switches 201*a* and 201*b*, and the corresponding parts of the tee-off switch 201*c* are carried by a common insulating support 232 mounted on the housing 202. Moreover, the contact fingers 207 of all three switches are carried by a common support arm 206 which is in turn supported by the support 232. Again, the screening effect of the support members 208 is of particular importance since the coils 209 are shielded thereby against the effects of adjacent current-carrying conductors.

If desired, a fourth switch can be provided which shares the field coil and arcing electrode of the tee-off switch 201*c* in the same manner as described above in relation to the ring main switches 201*a* and 201*b*. Again, a mechanical interlock will be used to prevent simultaneous opening of the switches. Reference 233 shows in broken line the manner in which a conductor and bushing for the fourth switch would be arranged on the housing 202.

Figure 7:
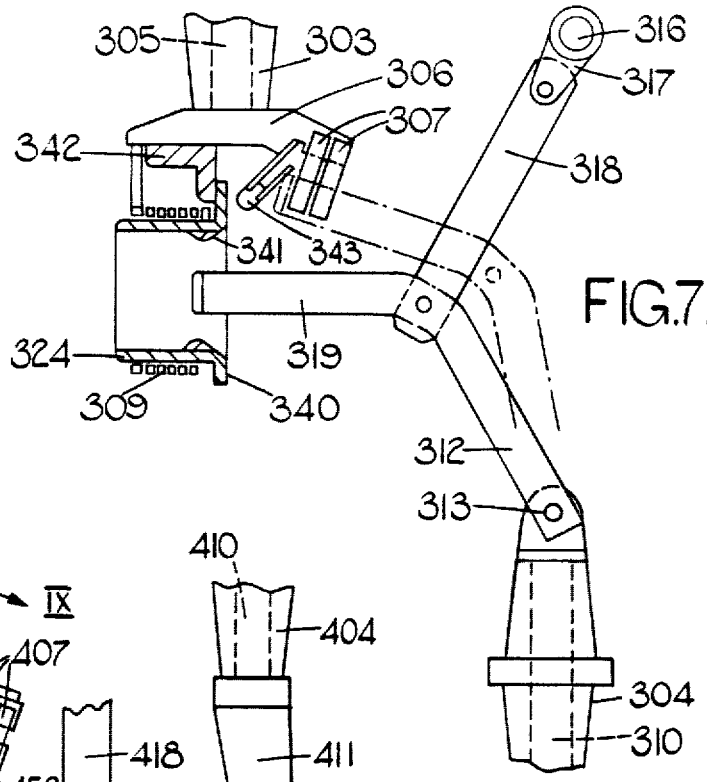
FIG. 7 shows a number of modifications which can be applied to any of the above embodiments.

FIG. 7 illustrates a number of modifications which can be applied, singly or in combination, to any of the embodiments described above. Those components or elements which correspond to the parts of the switchgear embodiments already described are denoted by the same reference numerals as used in FIGS. 1 and 2 but with 300 added, and will not in general be described again.

In FIG. 7, a cranked contact arm 312 is used instead of a straight one, the arm being pivoted at a point spaced from the axis of the field coil 309 so that in the open position of the switch the end portion 319 of the contact arm not only lies along the axis of the field coil but also extends into the adjacent end of the arcing electrode 324. This arrangement helps in transferring the arc from the contact fingers 307 to the electrode 324, and brings the arc within the coil where the magnetic field is more concentrated.

The arcing electrode 324 has a radial flange 340 at an end thereof which faces the contact arm 312 and is also provided with an internal annular insert 341 of bulged cross-section. The insert forms a so-called arc runner along which the arc tracks during its rotation, so that the arc can be made to rotate in a predetermined plane which is chosen with regard to the magnetic field generated by the field coil. The arrangement as illustrated is not suited to being shared between two switches: however, the provision of a flange and an annular insert at the other end of the electrode to give a symmetrical construction and the addition of a central insulating member similar to that referenced 231 in FIG. 6 will enable the arrangement to be made common to two switches.

The field coil 309 is helically, rather than spirally, wound. If the coil is to be shared between two switches, it is to be appreciated that the inherent asymmetry of the helical coil may result in some difference in operating characteristics between thw two switches. Because the helical coil 309 is not self-supporting, a separate mechanical support is provided for the arcing electrode 324. This support can be in the form of an electrically-insulating member 342 as shown, or the coil can be cast onto the electrode using, for example, an epoxy resin.

An electrically conductive finger 343 is provided on the support arm 306 adjacent the contact fingers 307, the initial arc being drawn from this finger rather than from the contact fingers 307 when the contact arm 312 moves away from the latter. The finger 343 can thus be made of arc-resistant material, whereas this may not be desirable for the contact fingers 307.

Figure 8:
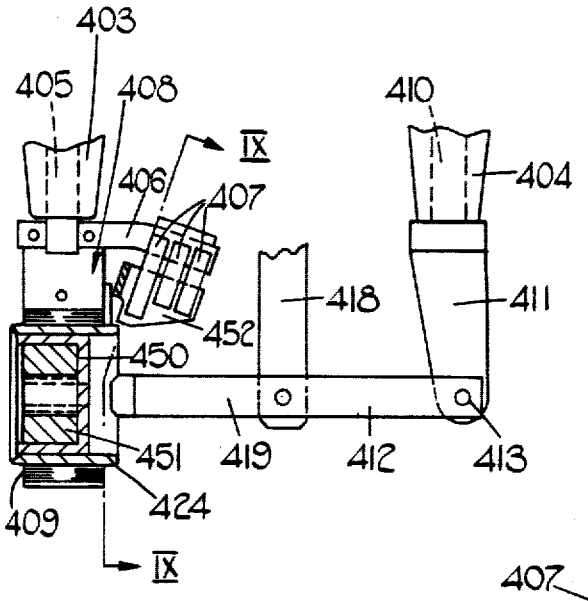
FIG. 8 shows a further modification which can also be applied to any of the above embodiments.
Figure 9:
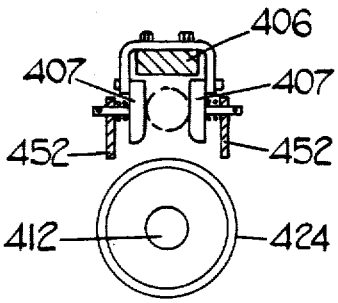
FIG. 9 is a sectional view taken along the line IX—IX in FIG. 8.

FIGS. 8 and 9 show two modifications (usable singly or in combination) to the switchgear of FIGS. 1 and 2 but which can likewise be applied to the switchgear embodiments of FIGS. 3 to 6 and which can be used in combination with modifications shown in FIG. 7. Components or elements shown in FIGS. 8 and 9 which correspond to parts described already are given the same reference numerals as used in FIGS. 1 and 2 but with 400 added, and will not in general be described again.

In FIGS. 8 and 9, an insulated supporting cup 450 is provided within the arcing electrode 424 and has mounted therein a ferromagnetic ring 451. The cup 450 shields the ring 451 from the arc, and the ring concentrates the magnetic field produced by the field coil 409 to aid arc extinction. The action of the ring is of particular benefit when breaking relatively low currents. For some applications of the switchgear, it may be desirable to permit a flow of gas axially through the electrode 424, and for this reason, the supporting cup 450 can be made of annular configuration as indicated in broken line in FIG. 8.

A ferromagnetic yoke 452 is provided to concentrate the magnetic field to encourage the initial arc to stay at the end of the contact arm 412 to facilitate transfer to the electrode 424. If desired, the yoke 452 can be covered in insulating material (for example, epoxy resin) to enable it to be placed close to the initial arc. The yoke enhances the action of the electromagnetic loop defined by the contacts and the arc.

Figure 10:
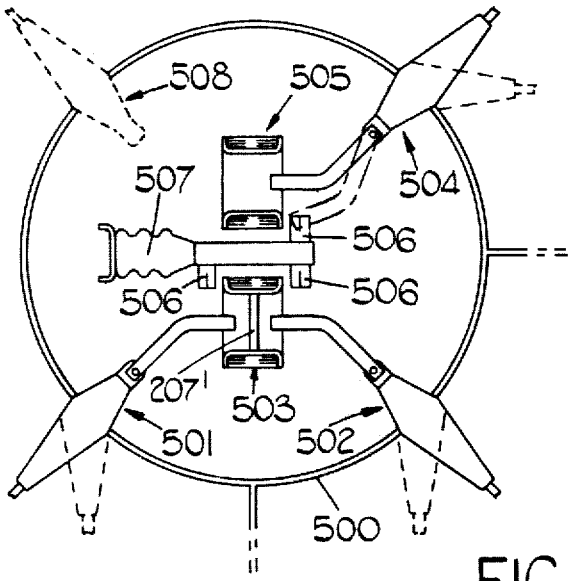
FIG. 10 is a schematic diagram of a fourth embodiment of electrical switchgear according to the present invention, also for use with ring main equipment.

FIG. 10 shows schematically how the features shown in FIGS. 6 and 7 can be combined to produce ring main switchgear of compact form. A metal housing 500 filled with sulphur hexafluoride gas has mounted therein two ring main switches 501 and 502 which share a common field coil assembly 503 and a tee-off circuit breaking or load break switch 504 (which has a similar function to the switch 201*c* in the embodiment of FIG. 5) which has an associated field coil assembly 505. The field coil assemblies 503 and 505 and fixed contact assemblies 506 for the various switches are all carried by a common insulating support 507. An insulating member 507' is provided transversely of the shared coil assembly 503 to isolate the contact arms of the ring main switches 501 and 502 from one another when in their open positions. If desired, a fourth switch whose bushing is indicated in broken line at 508 can also be provided to share the field coil assembly 505 with the switch 504. The conductor bushings for the switches 501, 502 and 504 can be arranged radially of the housing 500 as shown in full lines, or tangentially of the housing as indicated in broken lines.

If desired, features shown in FIGS. 8 and 9 can also be provided in this arrangement.

Figure 11:
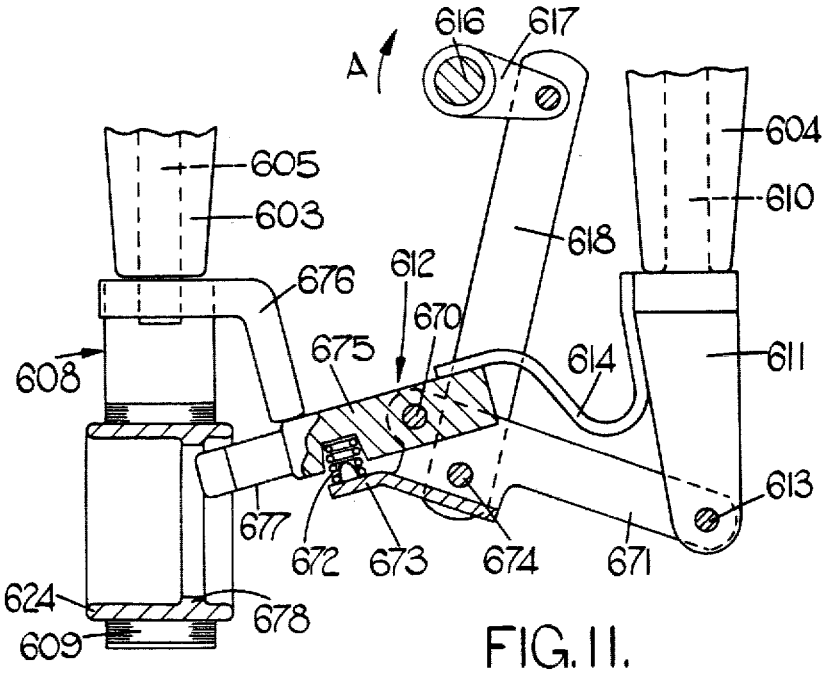
FIGS. 11 to 13 are schematic views of a fifth embodiment of electrical switchgear according to the present invention, showing the switchgear respectively in three different positions.
Figure 12:
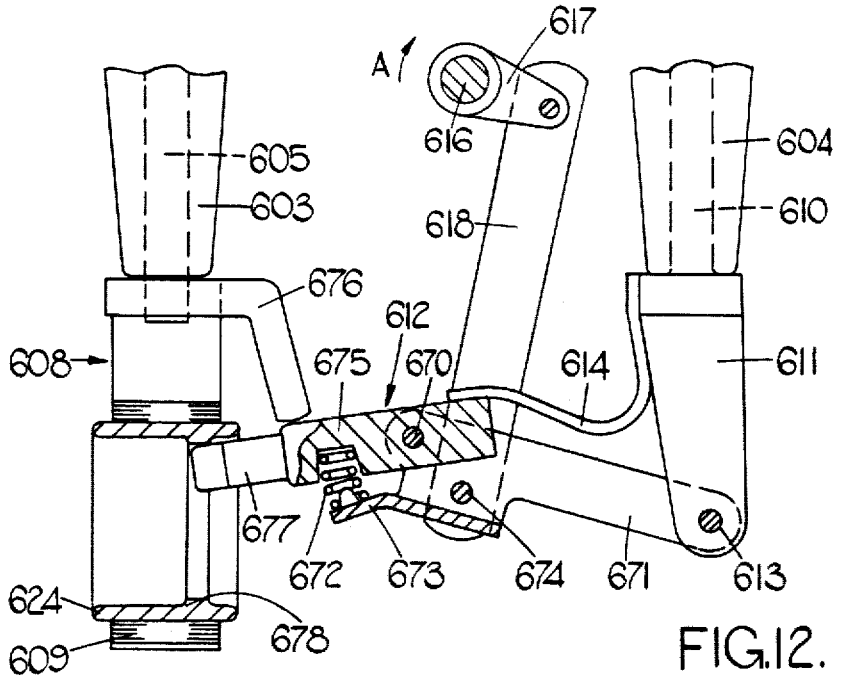
Figure 13:
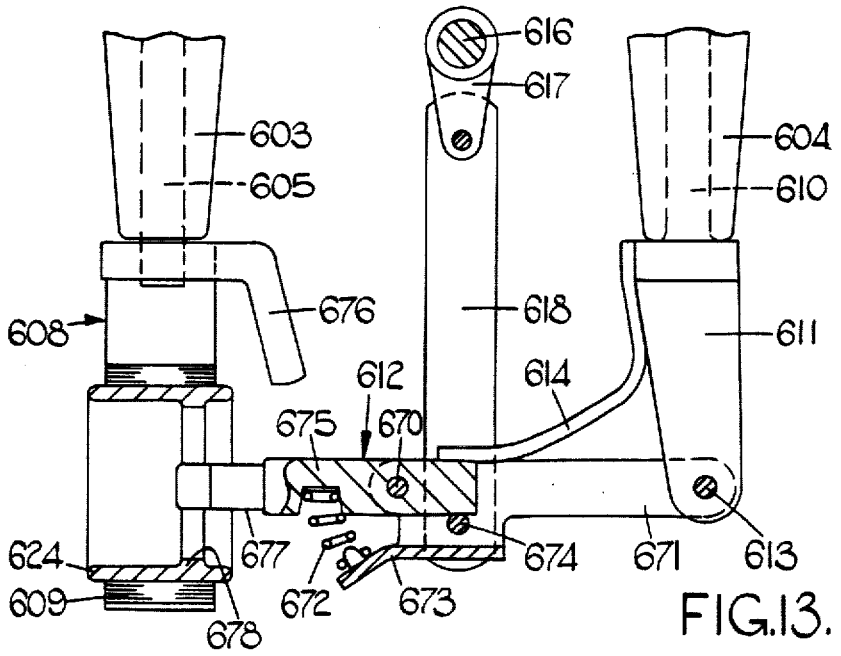

FIGS. 11, 12 and 13 show part of a circuit breaker which is generally similar to that described above with reference to FIGS. 1 and 2, similar parts being accorded the same reference numerals but with 600 added. The arrangement of the pivotable contact arm is, however, somewhat modified as will now be described.

The contact arm 612 is now pivotally mounted by means of a pivot 670 on one end of a conductive link member 671, a compression spring 672 being interposed between the contact arm and an abutment 673 on the link member. The link member 671 is pivotally mounted at its other end on mounting 611 and is also pivotally connected to linkage 618 by means of a pivot pin 674.

FIG. 11 shows the circuit breaker in a closed position, in which a main body portion 675 of the contact arm 612 is biased into engagement with a main contact 676 connected to conductor 605. In this position, an end portion 677 of the contact arm is spaced from the arcing electrode 624. The circuit breaker is opened by rotating operating shaft 616 in the direction of arrow A which results in the contact arm 612 rocking on the tip of the main contact 676 until the end portion 677 of the contact arm engages an arc runner 678 on the interior of the electrode 624. Further rotation of the operating shaft 616 causes the contact arm 612 to disengage from the main contact 676 while still remaining in contact with the arc runner 678, as shown in FIG. 12.

On continued rotation of the shaft 616, the end portion 677 of the contact arm 612 maintains contact with the arc runner 678 until the main body portion 675 comes into engagement with the pivot pin 674 which acts as a stop. Thereafter, the end portion 677 moves away from the arc runner 678 transversely of the field coil axis so that an arc is drawn therebetween radially within the field coil 609. In the fully-open position of the circuit breaker, shown in FIG. 13, the end portion 677 of the contact arm lies along the field coil axis and the arc rotates to extinction under the effect of the magnetic field produced by the field coil.

Figure 14:
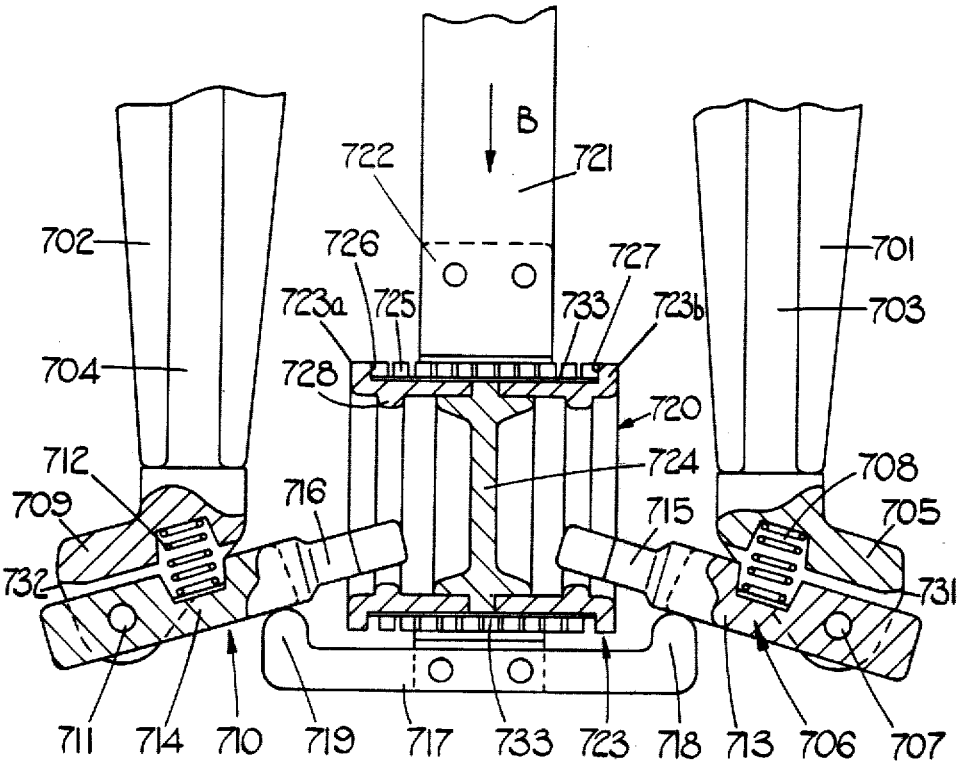
FIG. 14 is a schematic view of a sixth embodiment of electrical switchgear according to the present invention, in the form of a double-break circuit breaker.

The circuit breaker shown in FIGS. 11 to 13 is of the so-called single break type. FIG. 14 shows a similar form of circuit breaker but of double break type. A metal housing (not shown) contains sulphur hexafluoride gas and mounts insulating terminal bushings 701 and 702 through which pass respective conductors 703 and 704. A mounting 705 for a contact arm 706 is provided at an end of the conductor 703, the arm 706 being pivoted on the mounting 705 at a point 707. A helical contact spring 708 in compression acts between the mounting 705 and the contact arm 706. A mounting 709, contact arm 710, pivot point 711 and spring 712 are similarly associated with the conductor 704. The contact arms 706 and 710 each comprise a main body portion 713, 714 of rectangular cross-section and an end portion 715, 716 of lesser and circular cross-section. The tips of the end portion 715 and 716 can be provided with arc-resistant material.

A main contact bar 717 has ends 718 and 719 which in the closed position of the circuit breaker contact respectively the main body portions 713 and 714 of the contact arms 706 and 710. The springs 708 and 712 act to urge their associated contact arms into contact with the main contact bar 717, and a current path thus exists from conductor 703 to conductor 704 by way of mounting 705, arm 706, main contact bar 717, arm 710 and mounting 709.

The main contact bar 717 and a field coil assembly 720 are mounted on the end of reciprocable insulating shaft 721 by means of a support member 722. The field coil assembly 720 comprises a tubular arcing electrode 723 formed in two conducting sections 723*a* and 723*b* which are separated by a central insulating barrier 724, and a helical field coil 725 wound on the outside of the electrode 723. One end of the coil 725 is connected to the electrode section 723*a* at a point 726, the other end of the coil being connected to the section 723*b* at a point 727: otherwise, the coil is insulated from the electrode 723 by insulation 733. The sections 723*a* and 723*b* are provided with respective internal annular projections or arcing rings 728 and 729 which can be surfaced with arc-resistant material. The end portions 715 and 716 of the contact arms lie within the field coil assembly 720 and are adjacent to but spaced from the arcing rings 728 and 729 in the closed position of the circuit breaker.

The contacts of the circuit breaker are opened by movement of the shaft 721 in the direction of the arrow B by a suitable mechanism (not shown), the field coil assembly 720 and main contact bar 717 moving with the shaft since they are carried by it. As the shaft 721 moves in the direction of arrow B, the contact arms 706 and 710 pivot under the action of their respective springs 708 and 712 to follow the motion of the main contact bar 717. On further movement of the shaft 721, the end portions 715 and 716 engage the arcing rings 729 and 728 respectively and the main body portions 713 and 714 become spaced from the main contact bar 717. Ignoring any minor arcing at the main contact bar 717, the current path from conductor 703 to conductor 704 is now by way of end portion 715, section 723*b*, coil 725, section 723*a* and end portion 716. The pivotal movement of the arms 706 and 710 is limited by parts 731 and 732 of the mountings 705 and 709 acting as stops and at their limits of movement the arms lie along a common axis.

On continued movement of the shaft 721, the arcing rings 728 and 729 move out of contact with the contact arms 706 and 710 and an arc is drawn radially between the end portion of each contact arm and the associated arcing ring. Movement of the shaft ceases when the axis of the field coil assembly 720 is in alignment with the common axis of the contact arms. The current path from conductor 703 to conductor 704 is now by way of contact arm 706, the arc between end portion 715 and arcing ring 729, coil 725, the arc between arcing ring 728 and end portion 716, and contact arm 710. The magnetic field generated by the current flowing in the coil 725 causes the arcs to rotate and become extinguished.

As an alternative to the use of circular cross-section components, the contact arms on the embodiments of FIGS. 1 to 13 can be of rectangular cross-section, and the field coil and arcing electrode can be of oval cross-section. The use of a rectangular cross-section contact arm is advantageous in that any burning caused by the arc upon opening of the switch under fault conditions occurs at the corners of the contact arm, the side surfaces of the contact arm which engage the fixed contact fingers in the closed position of the switch being substantially unaffected by such burning.

The invention has other applications besides the distribution switchgear described above. It is applicable to the control of industrial circuits and to distribution and transmission circuits at higher voltages. It can also be applied to circuit breakers and switches having an insulated enclosure.

I claim:

1. Electrical switchgear comprising:

(a) a housing containing an electrically insulating fluid;

(b) an electrically conductive arcing electrode disposed in said housing;

(c) a switch disposed in said housing and including first contact means and second contact means which are relatively movable between a closed position in which said first and second contact means are mutually engaged and an open position in which said first and second contact means are mutually separated, movement of said first and second contact means out of said closed position and towards said open position causing an electrical arc discharge to be formed between said first contact means and said arcing electrode, and;

(d) a field coil having an axis and electrically connected in series with said arcing electrode, an arcing current flowing through said field coil when said electrical arc discharge is formed between said first contact means and said arcing electrode and producing a magnetic field which causes said electrical arc discharge to rotate between said first contact means and said arcing electrode and become extinguished;

(e) said first contact means including an electrically conductive contact arm which is pivotable about a pivot axis transverse to said field coil axis, said contact arm having an end portion which moves transversely to and inwardly of said field coil axis on movement of said first and second contact means away from said closed position and towards said open position.

2. The electrical switchgear according to claim 1, wherein said end portion of said contact arm is elongate and lies along said field axis when said first and second contact means are in said open position.

3. The electrical switchgear according to claim 1, wherein said end portion of said contact arm extends into said field coil when said first and second contact means are in said open position.

4. The electrical switchgear according to claim 1, wherein said pivot axis of said contact arm is spaced from said field coil axis.

5. The electrical switchgear according to claim 1, wherein said contact arm has a bend therein and said pivot axis is disposed on an opposite side of said bend to said end portion.

6. The electrical switchgear according to claim 1, further comprising a ferromagnetic member disposed at least partly within said field coil to concentrate said magnetic field.

7. The electrical switchgear according to claim 6, wherein said arcing electrode is tubular and said ferromagnetic member is disposed in said arcing electrode.

8. The electrical switchgear according to claim 6, wherein said ferromagnetic member is of annular shape.

9. The electrical switchgear according to claim 1, wherein said field coil is electrically connected to said second contact means, and during movement of said first and second contact means towards said open position said electrical arc discharge is first drawn between said first contact means and said second contact means and is then transferred from said second contact means to said arcing electrode.

10. The electrical switchgear according to claim 9, further comprising a ferromagnetic yoke associated with said second contact means to assist in initially positioning said electrical arc discharge at said end portion of said contact arm on movement of said first and second means out of said closed position.

11. The electrical switchgear as according to claim 1, wherein said contact arm engages said arcing electrode before disengaging from said second contact means during movement of said first and second contact means out of said closed position and towards said open position.

12. The electrical switchgear according to claim 1, wherein said field coil is composed of a strip of conducting material wound in a spiral, said spiral having an outer end which is attached to mounting means and an inner end which mounts said arcing electrode.

13. The electrical switchgear according to claim 1, wherein said arcing electrode is in the form of a tubular member having an external surface around which said field coil is disposed.

14. The electrical switchgear according to claim 13, wherein said tubular member has a flange which faces said contact arm.

15. The electrical switchgear according to claim 13, wherein said tubular member has an internal annular projection along which said electrical arc discharge runs during its rotation.

16. The electrical switchgear according to claim 1, further comprising a further switch disposed in said housing and including third contact means which are relatively movable between a closed position in which said third and fourth contact means are mutually engaged and an open position in which said third and fourth contact means are mutually separated, said third contact means including an electrically conductive contact arm which is pivotable about a pivot axis transverse to said field coil axis and which has an end portion which engages said fourth contact means when said third and fourth contact means are in said closed position and which moves transversely to said field coil axis on movement of said third and fourth contact means away from said closed position and towards said open position, an electrical arc discharge being formed between said third contact means and said arcing electrode and an arcing current passing through said field coil to create a magnetic field which causes said electrical arc discharge to rotate between said third contact means and said arcing electrode and become extinguished, said third contact means being disposed on an opposite side of said field coil to said first contact means.

17. The electrical switchgear according to claim 16, wherein said arcing electrode is in the form of a tubular member common to both said switch and said further switch.

18. The electrical switchgear according to claim 16, wherein an electrically insulating member is arranged transversely within said tubular member.

19. The electrical switchgear according to claim 1, comprising a plurality of switches disposed in said housing, each said switch having respective first and second contact means, said second contact means of said plurality of switches being mounted on a common electrically insulating support.

20. The electrical switchgear according to claim 19, comprising three switches and two field coils, one of said field coils being common to two of said switches.

21. The electrical switchgear according to claim 19, comprising four switches and two field coils, each said field coil being common to a respective pair of said switches.

22. The electrical switchgear according to claim 1, comprising a plurality of switches disposed in said housing, each said switch having a respective field coil and a respective arcing electrode, said switches being disposed substantially on a common axis and said field coils being mutually staggered transversely of said common axis.

23. The electrical switchgear according to claim 22, comprising three switches whose associated field coils are disposed in a triangular array.

24. The electrical switchgear according to claim 1, wherein said electrically insulating fluid is sulphur hexafluoride gas.

* * * * *